US008955562B2

(12) United States Patent
Krulitsch

(10) Patent No.: US 8,955,562 B2
(45) Date of Patent: Feb. 17, 2015

(54) FILLING ELEMENT AND FILLING SYSTEM COMPRISING SUCH A FILLING ELEMENT

(75) Inventor: Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 772 days.

(21) Appl. No.: 13/124,429

(22) PCT Filed: Oct. 28, 2009

(86) PCT No.: PCT/EP2009/007689

§ 371 (c)(1),
(2), (4) Date: Apr. 15, 2011

(87) PCT Pub. No.: WO2010/054746

PCT Pub. Date: May 20, 2010

(65) Prior Publication Data

US 2011/0197993 A1 Aug. 18, 2011

(30) Foreign Application Priority Data

Nov. 17, 2008 (DE) ..... 10 2008 057 752

(51) Int. Cl.
*B65B 3/04* (2006.01)
*B67C 3/04* (2006.01)
*B67C 3/26* (2006.01)

(52) U.S. Cl.
CPC ..... *B67C 3/045* (2013.01); *B67C 3/2637* (2013.01)
USPC ..... 141/148; 141/82; 141/146; 141/198; 141/275; 141/302; 141/392

(58) Field of Classification Search
CPC ..... B67C 3/045; B67C 3/26; B67C 3/2637
USPC ..... 141/59, 82, 144–152, 198, 275, 308, 141/392
See application file for complete search history.

(56) References Cited

U.S. PATENT DOCUMENTS

| | | | | |
|---|---|---|---|---|
| 3,589,410 | A | 6/1971 | Manas | |
| 6,817,386 | B2 * | 11/2004 | Tsukano et al. | 141/57 |
| 8,251,107 | B2 * | 8/2012 | Clusserath et al. | 141/59 |

FOREIGN PATENT DOCUMENTS

| | | |
|---|---|---|
| DE | 20105716 | 5/2002 |
| EP | 1559674 | 8/2005 |
| EP | 1575863 | 9/2005 |
| WO | 2008/116559 | 10/2008 |

* cited by examiner

*Primary Examiner* — Timothy L Maust
*Assistant Examiner* — Timothy P Kelly
(74) *Attorney, Agent, or Firm* — Occhiuti & Rohlicek LLP

(57) ABSTRACT

A filling element for filling systems for filling bottles or similar containers (2) with a hot liquid product, comprising a liquid channel (14, 15), which is formed in the filling element (1), has a filling valve (9) and forms at least one discharge opening, via which, by controlled opening and closing of the liquid valve (9), the liquid product can be introduced into the respective container (2) that has been raised towards the filling element (1) in a lifting movement, and comprising at least one flow path (16, 17, 18), which is formed in the liquid valve (1) and, for heating the filling element (1), can be connected to a hot circulation of the liquid product, characterized in that control means (5.2) are provided and, by the lifting movement of the container (2) to be filled, open the liquid valve (9) and block the flow path (16, 17, 18) for the hot circulation or reduce the effective flow cross section of this flow path (16, 17, 18), and in that optionally, at least over part of the length of the flow path (16, 17, 18) for the hot circulation, the inner surface of this flow path is profiled, for example provided with ribs (30), to increase the surface area that comes into contact with the product and/or to create a turbulent flow of the product.

22 Claims, 5 Drawing Sheets

FILLING ELEMENT AND FILLING SYSTEM COMPRISING SUCH A FILLING ELEMENT

CROSS-REFERENCE TO RELATED APPLICATIONS

This application is the National Stage of International Application No. PCT/EP2009/007689, filed on Oct. 28, 2009, which claims the priority of German Patent Application No. 10 2008 057 752.9, filed on Nov. 17, 2008. The contents of both applications are hereby incorporated by reference in their entirety.

FIELD OF INVENTION

The invention relates to a filling device for filling containers with hot liquid.

BACKGROUND

To achieve hot, sterile filling, it is often necessary to fill products at a high product temperature. These product temperatures can be as high as 90 and 95° C.

A problem that can arise with this type of hot filling process or with the filling devices that are used for this hot filling is that the filling devices that are used for the controlled filling of the product must already be at the elevated product temperature before the filling process is commenced. Otherwise, the content that is to be introduced to the filling devices may cool down in an undesirable manner during the filling process. To avoid this, it is known to pre-heat filling devices prior to starting the filling process.

In a similar way, in the event of any interruptions to a filling process, both the content and the filling devices must be maintained within the required temperature range so that the filling process can be restarted immediately using filling devices that are at the correct temperature.

Filling systems or filling machines for resolving these problems are already known. In these known devices, the filling devices are drawn into a heating device by conducting a partial current of the hot content through the filling device in a closed circulation that has a heating device. This heats the contents and/or maintains them at the respective required temperature.

A negative aspect of these known filling systems or filling machines is, among other things, the need for exceptionally costly, delicate, and high-priced ventilation arrangements.

SUMMARY

The task of the invention is to present a filling device, that can be heated with a simplified design in circulation path of the hot liquid.

A special advantage of the invention arises from the fact that both the liquid valve of the respective filling device and addition the flow channel that has been designed for the hot circulation are controlled solely by the movement of the particular container that is to be filled. Thus, when the container is connected to and/or pressed onto the filling device, the liquid valve is opened and the flow path for the hot circulation is thereby closed or restricted and reversed. When the filled container is removed from the filling device, the liquid valve is closed, and the flow path for the hot circulation is fully opened.

Further modifications, advantages and possible applications of the invention also result from the following description of examples of the design and from the illustrations. In this, all of the characteristics described and/or presented in illustrated form are basically the object of the invention either on their own or in any combination, regardless of their summarization in the claims or of their retroactive application. Also the content of the claims is made as an integral part of the description.

DESCRIPTION OF THE DRAWINGS

The invention is explained here-below in greater detail by means of illustrations of an example of the design in which.

DETAILED DESCRIPTION

Figure 1:
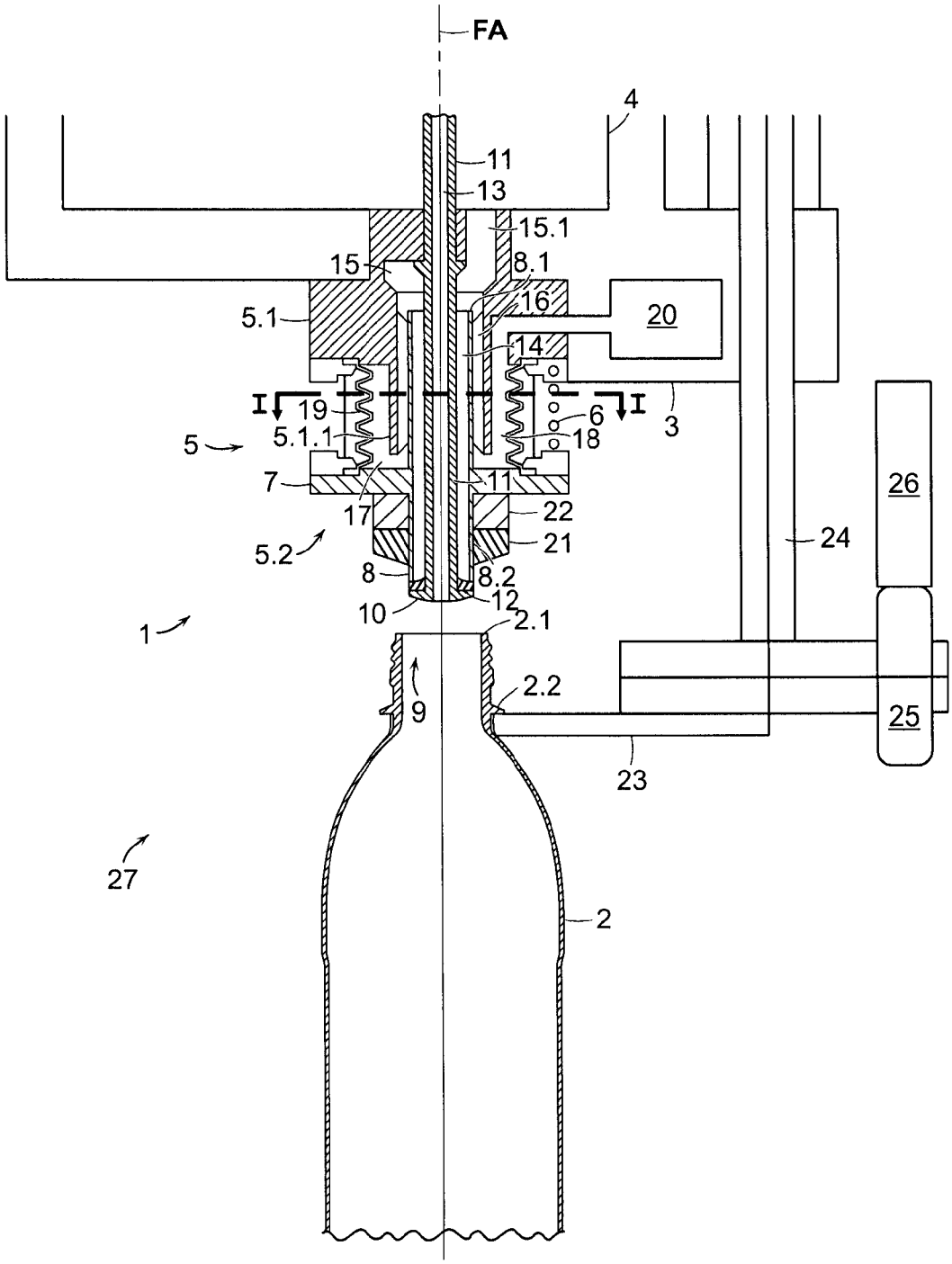
FIG. 1 shows a rotating filling machine with the filling device closed, together with a bottle lowered relative to the filling device.

FIG. 1 shows a filling device 1 of a rotating filling machine for the non-pressurized filling of containers in the form of bottles 2 with hot liquid contents. By way of an example, the hot liquid contents are at a temperature of between about 90 and 95° C.

The filling device 1 is installed, together with a large number of similar filling devices 1 of a similar design, on the periphery of a drivable rotor 3 that rotates around a vertical machine axis. This has, among other things, a common boiler 4 for all of the filling devices. One example of a boiler 4 is a ring-type boiler. The boiler 4 is partly filled with the hot liquid contents. The level of hot liquid in the boiler 4 is controlled to be at the level N. As a result, within the inner chamber of the boiler 4, there is a lower liquid chamber 4.1 and a gas chamber 4.2 above it. Hot liquid content flows into the lower liquid chamber 4.1, while inert gas fills the gas chamber 4.2.

Each filling device 1 has a filling device casing 5 fixed on the base of the boiler 4. Each filling device casing 5 has two pieces: a first casing part 5.1 and a second casing part 5.2. The first casing part 5.1 is fixed to the rotor 3 or to the base of the boiler 4. The second casing part 5.2 is positioned vertically in relation to the first casing part 5.1.

Figure 2:
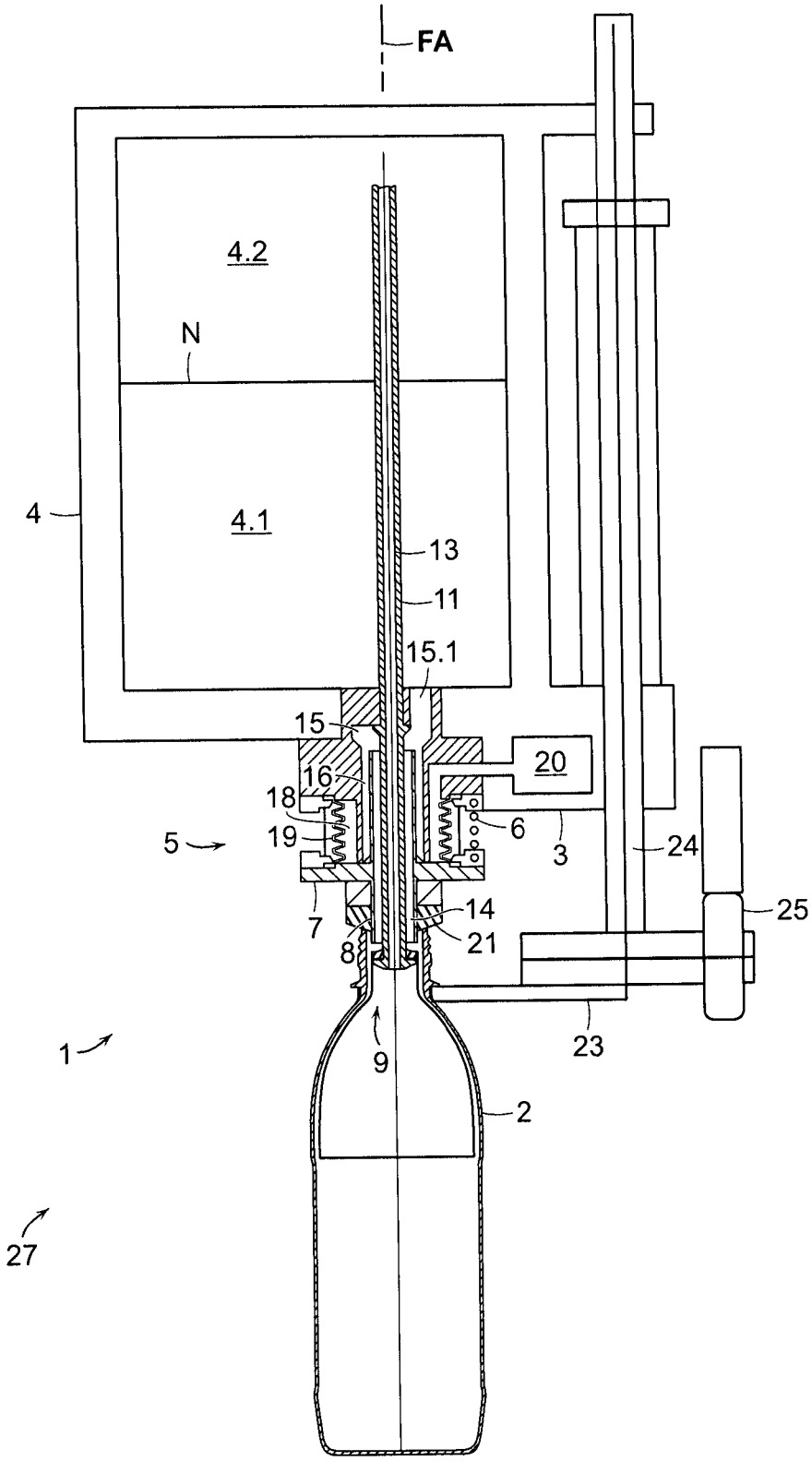
FIG. 2 shows the filling position of FIG. 1 with the bottle raised against the filling device and ready to be filled.
Figure 3:
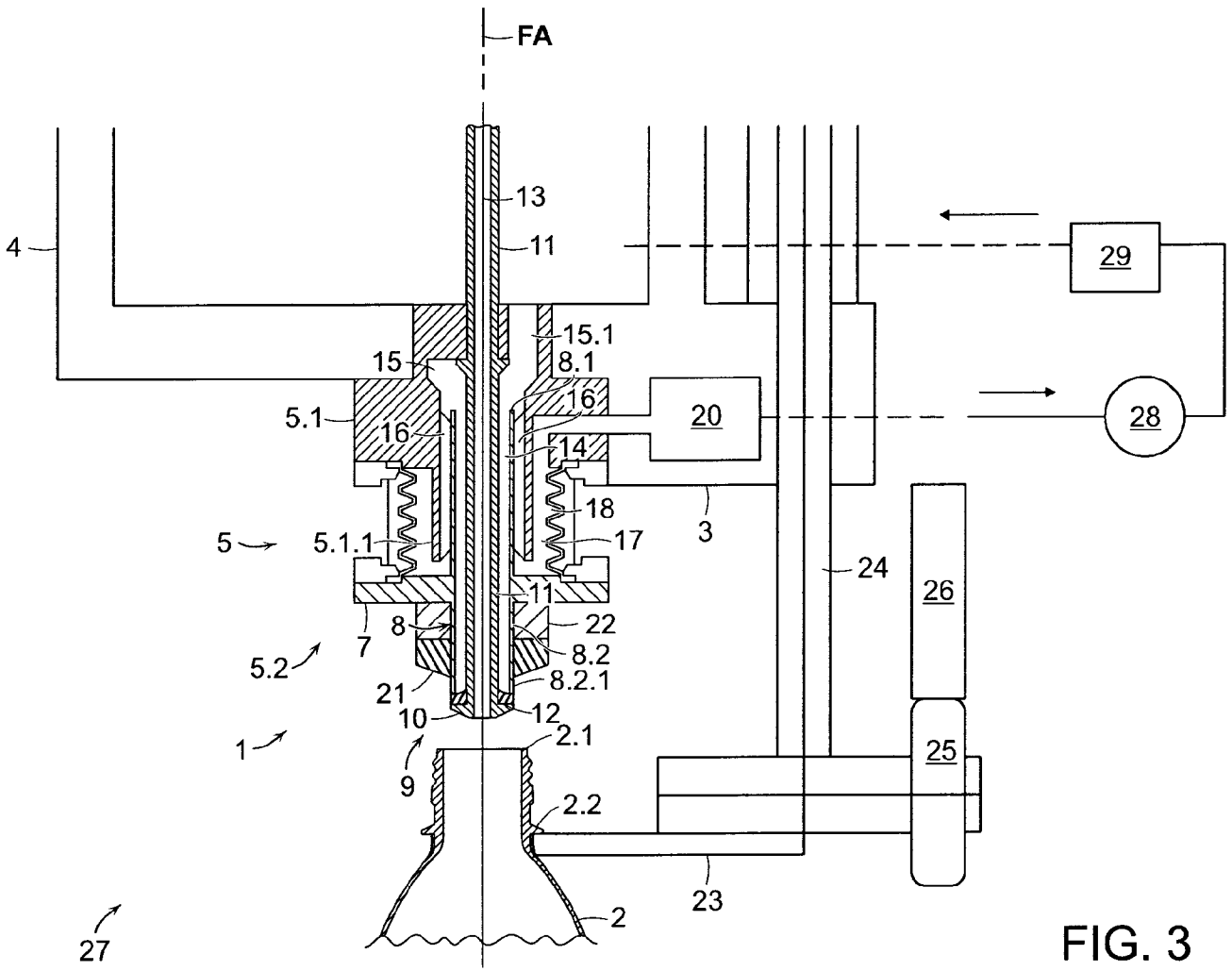
FIGS. 3 and 4 show enlarged views of the closed and opened liquid valves of FIGS. 1 and 2.
Figure 4:
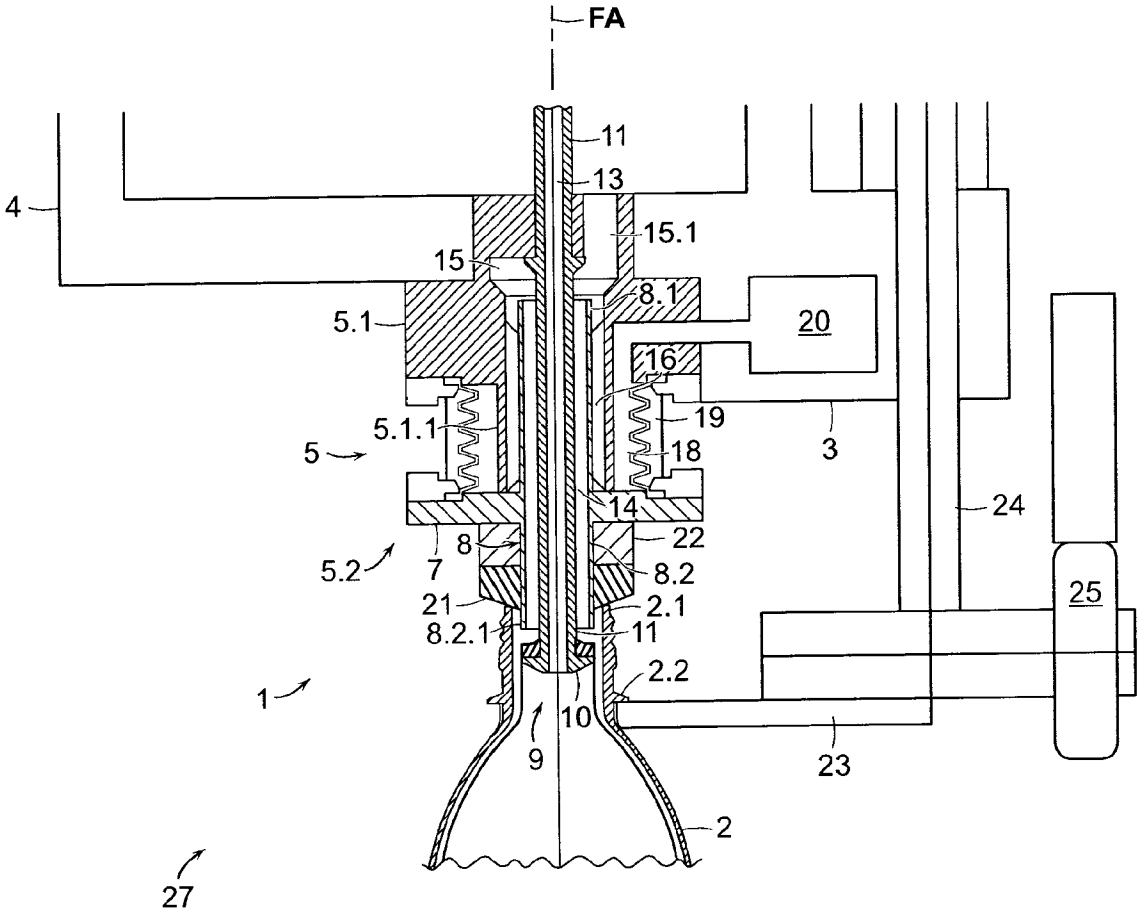

The second casing part 5.2 is movable in the direction of a filling-device axis FA between a lower lift position and an upper lift position. The lower lift position is shown in FIG. 1 or 3, and the higher lift position is shown in FIG. 2 or 4.

A compression spring 6 acting between the first and second casing parts 5.1, 5.2 pre-stresses the second casing part 5.2 into the lower lift position. This compression spring 6 is fitted in the side of the casing and concentrically encloses the filling-device axis FA.

The second casing part 5.2 includes a valve plate 7 that is perpendicular to the filling-device axis FA. The compression spring 6 abuts against a top side of this valve plate 7.

A filler pipe 8 that is open at both ends passes through the valve plate 7 in a sealed manner and penetrates into the first casing part 5.1 with its upper filler pipe section 8.1. A lower filler pipe section 8.2 of filler pipe 8 projects below the base of the valve plate 7 and forms a delivery opening at its lower end. A liquid valve 9 at this lower end controls filling of the bottles 2 with the liquid content. The operation of the valve 9 will be described in more detail below.

In the illustrated embodiment, the liquid valve 9 is a foot valve having a valve body 10 at a lower projecting end of a gas return pipe 11. The gas return pipe 11 is arranged on the same axis as the filling-device axis FA and works in conjunction with a valve body surface. A seal 12 is formed from the lower edge of the opening of the lower filler pipe section 8.2.

The gas return pipe 11 extends through the valve casing 5 and, in a sealed manner, through the liquid chamber 4.1 of the boiler into the adjacent gas chamber 4.2. In doing so, the gas return pipe 11 defines a gas return channel 13. In the version of the design, the gas return channel 13 remains constantly open at the base of the filling device 1, i.e. in the valve body 10 and also on the end of the pipe that extends into the gas chamber 4.2.

A first annular channel 14 is formed within the filler pipe 8 between its inner surface and an outer surface of the gas return pipe 11. This first annular channel 14 discharges into a channel 15 in the first casing part 5.1 that is formed at the top end of the filler pipe 8. This channel 15 connects to the liquid chamber 4.1 of the boiler 4 at the base of the boiler 4.

The channel 15 has an annular channel section 16 that concentrically encloses the filling-device axis FA. This annular channel section 16 is formed between the outer surface of the upper filler pipe section 8.1 and the inner surface of the casing part 5.1. In particular, the annular channel section 16 is bounded by an inner surface of a tube-like casing section 5.1.1 of the casing part 5.1 that encloses the upper filler pipe section 8.1. A clearance between the upper filler pipe section 8.1 and the inner surface 5.1.1 defines the width of the annular channel section 16.

Just above the valve plate 7, the tube-like casing section 5.1.1 has a lower annular opening 17 that surrounds the filling-device axis FA. The annular channel section 16 extends downwards to this lower annular opening 17. The annular opening 17 opens into a second annular channel 18 that encloses the casing section 5.1.1. The outer wall of this second annular channel 18 is a cladding that enables the second casing part 5.2 to move relative to the first casing part 5.1. As a result, the casing 5 can be axially shortened and lengthened in the direction of the filling-device axis FA. In the illustrated embodiment, the cladding is in the form of bellows 19.

The second annular channel 18 is connected to a third annular channel 20 on the top end that is located furthest away from the annular opening 17. The third annular channel 20 is provided in or on the rotor 3 and serves all of the filling devices 1 of the rotating filling machine. In the alternative, the third annular channel 20 serves a group of such filling devices.

A seal 21 is fitted around the lower filler pipe section 8.2 as it projects below the valve plate 7. The seal 21 abuts against the base of the valve plate 7 via a spacer 22. Below this seal 21, a filler pipe part length 8.2.1 of the lower filler pipe section 8.2 projects further downward.

A container support 23 is allocated to each filling device 1 of the rotating filling machine. As shown in FIG. 3, the container support 23 suspends a bottle 2 on a flare 2.2 that extends radially outward from the bottle just below a bottle mouth 2.1. A spring, which is not shown, biases the container support 23 into a raised lift position.

A guiding rod 24 guides the container support 23 onto the rotor 3 along the filling-device axis FA. This enables the container support 23 to be moved between a lowered lift position, shown in FIG. 1, and the raised lift position, shown in FIG. 2. A cam roller 25 controls the transition between these two lift positions. The cam roller 25 operates in conjunction with a control cam 26 that is not circumferential with the rotor 3. The container support 23 and its related filling device 1 together define a filling position 27.

A containers or bottles 2 is guided to a filling positions 27 with the container support 23 lowered. The bottle mouth 2.1 is positioned directly below the respective filling device 1 with clearance between the filling device 1 and the mouth 2.1. The container support 23, together with the bottle 2 that it suspends, is then raised until the bottle mouth 2.1 is against the seal 21.

The raised container support 23 overcomes the force of the spring 6 and thus moves the second casing part 5.2 upwards into the higher lift position. This opens the liquid valve 9. As a result, liquid content flows from the boiler 4 via a liquid channel formed by the channel 15 and the first annular channel 14 and the opened liquid valve 9, and enters the bottle 2. As liquid content enters the bottle, it forces compressed air is channeled from the bottle 2 through the gas return channel 13.

Eventually, the rising level of the content in the bottle 2 reaches the lower end of the gas return pipe 11 that has been inserted into the bottle 2. Immersion of this end into the liquid content closes the gas return channel 13 and automatically stops the filling. The filling level in the filled bottles 2 is determined by the filler pipe part length 8.2.1. This can be adjusted using spacers 22 with differing axial extents. When the container support 23 is lowered, taking the filled bottle 2 with it, the second casing part 5.2 is also lowered. This closes the liquid valve 9.

The filling level of the content in the respective bottles is thus determined by the length with which the lower filler pipe section 8.1 projects beyond the seal 21 and thereby, during the filling process, extends into the interior of the bottle 2 through the mouth of the bottle 2.1.

The lower lift position of the second casing part 5.2 is defined by the fact that the lower filler pipe section 8.2 is positioned with its lower edge against the body of the valve 10 or of its seal 12. The upper lift position of the second casing part 5.2 is defined by the fact that the valve plate 7 is positioned against the lower edge of the casing section 5.1.1.

A characteristic of the filling device 1 arises from the fact that it is possible to heat the filling device 1 by circulating hot liquid content from the boiler 4, through the filling device 1, and back to the boiler 4. In particular, for each filling device, hot liquid content circulates from the liquid chamber 4.2, through the channel 15, through the annular channel section 16, and the annular channel, into the third annular channel 20 and, from there, via a product pump 28 and a heating device 29 back, into the liquid chamber 4.1 of the boiler 4.

The foregoing circulation provides effective heating of the filling devices 1. As a result, the filling devices 1 can be pre-heated to the required raised product temperature, and can be maintained at the requisite desired temperature in the event of an interruption of the filling process. Because the circulation continues even when not filling, any hot content in the filling device does not remain there long enough to cool down. Thus, the filling devices 1 does not cool down, and filling can be started immediately without having to wait for the filling device 1 to heat back up. This permits prompt resumption of the filling process after an interruption.

A further characteristic arises from the fact that raising and lowering of the bottle 2 not only controls opening and closing of the liquid valve 9, but also controls the hot circulation through the filling device 1.

As a comparison of FIGS. 3 and 4 shows, the annular opening 17 for the hot circulation or for the flow-through of the annular channel section 16 and of the second annular channel 18 with the hot content is fully opened when the second casing part 5.2 in the lower lift position and the liquid valve 9 is closed.

Raising the second casing part 5.2 opens the liquid valve 9 and at the same time makes the annular opening becomes increasingly smaller. This reduces the effective flow cross-section of the flow path formed by the annular channel section 16 and the second annular channel 18. Eventually, the valve plate 7 reaches the lower edge of the casing section 5.1.1. This not only ends the upward lifting movement of the second casing part 5.2 but also completely closes the annular opening 17.

Closing the annular opening 17 interrupts the circulation loop. As a result, all of the liquid content that enters the filling device 1 enters the container through the liquid valve 9. None of it is diverted into a circulation loop. This results in the shortest possible filling time and thereby yields the highest possible output from the rotating filling machine (i.e. the number of filled bottles per unit of time.

In contrast, closing the liquid valve 9 is closed before and after the respective filling phase fully opens the annular opening 17 for the hot circulation.

The resulting filling device 1 has an exceptionally simple design. Yet, it manages to block and unblock the circulation loop as needed. All that is required to trigger this blocking and unblocking of the circulation loop is the raising and lowering of a bottle at the liquid valve 9.

Figure 5:
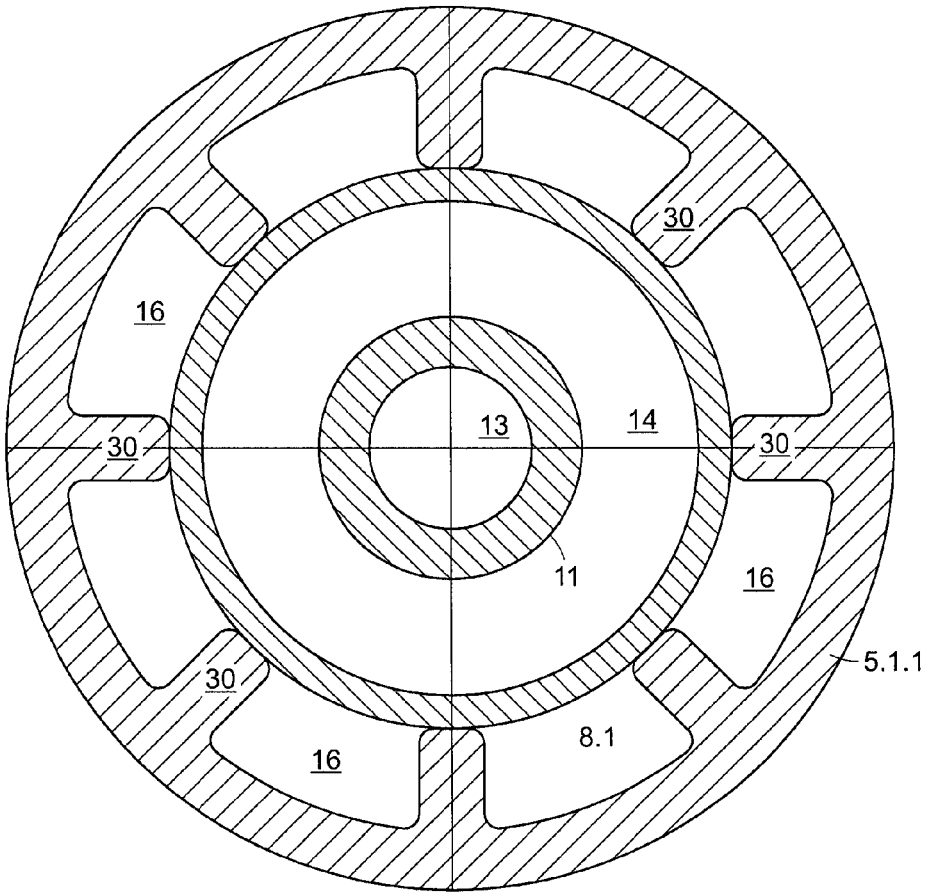
FIG. 5 shows a cross section of the casing parts of the two-piece filling device casing along the line I-I of FIG. 1.

FIG. 5 shows fins 30 projecting radially from the inner surface of the casing part 5.1 and of the tube-like casing section 5.1.1. These fins 30 extend to the outer surface of the upper filler pipe section 8.1. Thanks to these fins 30, there is a significant enlargement of the surface area that is in contact with the hot liquid content that flows through the annular channel section 16. This results in faster heat exchange.

Furthermore, the fins 30 cause a certain turbulence of the flow of the content. This also improves the release of heat transfer from the hot liquid content to the casing 5.

Having the hot liquid content follow a long path through the filling device 1 during circulation further enhances heat transfer. In the illustrated embodiment, the hot liquid content follows a twisted path through the filling device 1, thus providing many opportunities for heat exchange. Yet, the filling device 1 as a whole remains compact.

The invention has been described above using one example of the design. It should be understood that changes and variations are possible without thereby departing from original concepts of the design.

LIST OF DRAWING REFERENCES

1 Filling device
2 Support or bottle
2.1 Bottle mouth
2.2 Flange of the mouth
3 Rotor
4 Boiler
4.1 Liquid chamber of the boiler 4
4.2 Gas chamber of the boiler 4
5 Filling device casing
5.1, 5.2 First and second casing parts
5.1.1 Casing section
6 Spring
7 Valve plate
8 Filler pipe
8.1, 8.2 Upper and lower filler pipe sections
8.2.1 Filler pipe part length
9 Liquid valve
10 Valve body
11 Gas return pipe
12 Seal
13 Gas return channel
14 First annular channel
15 Channel
15.1 Opening
16 Annular channel section
17 Annular opening
18 Second annular channel
19 Movable cladding or bellows
20 Third annular channel
21 Seal
22 Spacer
23 Container support
24 Guide rod
25 Cam roller
26 Control cam
27 Filling position
28 Product pump
29 Heating device
FA Filling-device axis
N Level

The invention claimed is:

1. An apparatus for filling containers with hot liquid content, said apparatus comprising: a filling device having a liquid channel formed therein, a liquid valve forming at least one discharge opening from the liquid channel, through which the liquid content can be introduced, through a controlled opening and closing of the liquid valve, into containers that are raised against the filling device in a lifting movement, at least one flow path formed in the liquid valve for connection with a hot circulation of the liquid content for heating the filling device, and a controller that opens the liquid valve and simultaneously blocks or reduces the effective flow cross section of the flow path solely by raising the container to be filled.

2. The apparatus of claim 1, wherein the flow path for connection with the hot circulation is completely blocked or closed by the lifting movement of the container to be filled.

3. The apparatus of claim 1, wherein the controller comprises a casing comprising a casing part or device that is movable between at least a first lift position and a second lift position, the casing part or device including a container installation and/or sealing surface for the containers that are to be filled and being configured to be jointly moved with the latter in the lifting process.

4. The apparatus of claim 3, wherein at least a part of the liquid channel is formed in or on the movable casing part or device and/or in an adjacent filler pipe.

5. The apparatus of claim 4, wherein the liquid valve comprises a valve body, and a valve seat formed in and/or on the liquid channel and/or filler pipe, the valve seat being positioned against the valve body in the first lift position of the movable casing part or device for closing the liquid valve.

6. The apparatus of claim 3, wherein the casing part or device, in conjunction with a further casing part or casing section, forms at least one controllable opening in the flow path of the hot circulation, the controllable opening being closed or having a flow cross-section thereof reduced in response to a transition of the casing part or device into the second lift position.

7. The apparatus of claim 6, wherein the at least one controllable opening abuts against the movable casing part or device in the second lift position thereof.

8. The apparatus of claim 6, wherein the casing part or device extends into a channel formed in the further casing part with at least a first filler pipe section forming a part length of the liquid channel, the channel being connected to a tank or boiler for the liquid content, and wherein an annular channel section is formed between an outer surface of the first filler pipe section and an inner surface of the further casing part or of the casing section of the further casing part, the annular channel section being part of the flow path for the hot circulation.

9. The apparatus of claim 6, wherein the flow path for the hot circulation comprises at least two channels or channel sections formed within the filling device, wherein a flow direction in one of the two channels or channel sections is opposite the flow direction in the other of the two channels or channel sections.

10. The apparatus of claim 9, wherein at least one channel or channel section for the flow path is connected from the hot circulation to a channel connected to a tank or boiler for the liquid content.

11. The apparatus of claim 4, wherein the filler pipe projects with a further filler pipe section out of the casing.

12. The apparatus of claim 11, wherein the further filler pipe section forms the valve seat of the liquid valve that is produced at its end as a foot valve.

13. The apparatus of claim 4, further comprising a gas return pipe forming at least one gas return channel, the gas return channel being enclosed on one part length by the filler pipe in such a way that the part of the liquid channel that is formed in the movable casing part or device is an annular channel enclosing the gas return pipe.

14. The apparatus of claim 13, wherein the valve body of the liquid valve is fitted on the return gas pipe.

15. The apparatus of claim 1, wherein the flow path for the hot circulation comprises at least one inner channel or channel section, an outer channel or channel section that encloses the inner channel or channel section, the outer channel or channel section being limited by wall means extending between the movable casing part or device and the further casing part and enabling the movement of the movable casing part or device.

16. The apparatus of claim 1, further comprising fins on at least one part length of an inner surface of the flow path for the hot circulation, the fins being configured for raising the surface that comes into contact with the liquid content and/or profiled for creating a turbulence in the flow of the liquid content.

17. The apparatus of claim 1, further comprising a drivable rotor that rotates around a vertical machine axis, wherein the filling device is one of a plurality of identical filling devices mounted on the rotor.

18. The apparatus of claim 3, wherein the casing part or device is movable axially within a filling device axis.

19. The apparatus of claim 9, wherein the at least two channels or channel sections are connected to each other via the controllable opening.

20. The apparatus of claim 9, wherein the flow direction runs inversely into the channel sections along a filling device axis.

21. The apparatus of claim 10, further comprising a heating device for heating the liquid content before the liquid content is returned to the tank or to the boiler.

22. The apparatus of claim 15, wherein the wall means comprises bellows.

* * * * *